US007370774B2

(12) United States Patent
Watson et al.

(10) Patent No.: US 7,370,774 B2
(45) Date of Patent: May 13, 2008

(54) CAN END

(75) Inventors: Martin John Watson, Wantage (GB); Brian Fields, Lemont, IL (US); Andrew Robert Lockley, Wantage (GB)

(73) Assignee: Crown Cork & Seal Technologies, Alsip, IL (US)

( * ) Notice: Subject to any disclaimer, the term of this patent is extended or adjusted under 35 U.S.C. 154(b) by 0 days.

(21) Appl. No.: 11/540,238

(22) Filed: Sep. 28, 2006

(65) Prior Publication Data

US 2007/0029324 A1 Feb. 8, 2007

Related U.S. Application Data

(63) Continuation of application No. 10/770,791, filed on Feb. 3, 2004, now abandoned, which is a continuation of application No. PCT/EP03/03716, filed on Apr. 10, 2003.

(30) Foreign Application Priority Data

Apr. 22, 2002 (EP) ..... 02252800
Apr. 10, 2003 (WO) ..... PCT/EP03/03716

(51) Int. Cl.
*B65D 17/34* (2006.01)
*B65D 6/28* (2006.01)

(52) U.S. Cl. ..... 220/619; 220/269; 220/906

(58) Field of Classification Search ..... 220/269, 220/600, 615, 619, 623, 624, 733, 906
See application file for complete search history.

(56) References Cited

U.S. PATENT DOCUMENTS 3,441,170 A 4/1969 Khoury ..... 220/54
3,843,014 A * 10/1974 Cospen et al. ..... 220/623
4,808,052 A 2/1989 Bulso, Jr. et al. ..... 413/8
4,928,844 A * 5/1990 LaBarge ..... 220/203.08
5,645,189 A * 7/1997 Clowes ..... 220/623
5,829,623 A * 11/1998 Otsuka et al. ..... 220/269
6,065,634 A 5/2000 Brifcani et al. ..... 220/619
6,089,072 A 7/2000 Fields ..... 72/379.4
D452,155 S 12/2001 Stodd ..... D9/454
6,419,110 B1 7/2002 Stodd ..... 220/623
6,516,968 B2 2/2003 Stodd ..... 220/623

(Continued)

FOREIGN PATENT DOCUMENTS

EP 0 303 837 A2 2/1989
EP 0 828 663 B1 12/1999
EP 1 361 164 11/2003
WO 99/24326 5/1999
WO 03/035494 A1 5/2003
WO 03/059764 7/2003

*Primary Examiner*—Anthony D. Stashick
*Assistant Examiner*—Harry A Grosso
(74) *Attorney, Agent, or Firm*—Woodcock Washburn LLP

(57) ABSTRACT

A can end having a countersink bead, an inclined chuck wall and a strong seam, resists distortion from its circular profile when subjected to thermal processing or when packaging carbonated beverages. This high hoop strength affects the manner in which the can end ultimately fails when placed under extreme abuse conditions, even if buckle pressure performance is within industry specified standards. The can end of the invention has control features introduced which control the failure mode whilst maintaining specified buckle pressure performance. In one embodiment, the control feature comprises expansion of the countersink bead to act as a trigger for local peaking, together with a groove in the chuck wall which prevents the peaking force from being concentrated at a single point which could result in leaking by the production of a pin hole.

16 Claims, 4 Drawing Sheets

U.S. PATENT DOCUMENTS

| | | | | |
|---|---|---|---|---|
| D471,453 | S | 3/2003 | Stodd | D9/434 |
| D480,304 | S | 10/2003 | Stodd | D9/434 |
| 2003/0010785 | A1 | 1/2003 | Stodd | 220/623 |
| 2004/0159697 | A1 | 8/2004 | Turner et al. | 228/124.6 |

* cited by examiner

CAN END

This is a continuation of application Ser. No. 10/770,791 filed Feb. 3, 2004, now abandoned which is a continuation of PCT/EP03/03716 filed Apr. 10, 2003, which claims priority to EPO Application Ser. No. 02252800.4 filed Apr. 22, 2002.

BACKGROUND OF THE INVENTION

This invention relates to a can end and a method of manufacture of such a can end. In particular, it relates to a can end which has improved performance characteristics.

Containers such as cans which are used for the packaging beverages, for example, may contain a carbonated beverage which is at a higher than atmospheric pressure. Can end design has been developed to withstand this "positive" buckle pressure (sometimes also referred to as "peaking" pressure) up to defined minimum values (currently 90 psi for carbonated soft drinks) under normal operating conditions before failure. About 8 to 10 psi above this value, failure of conventional can ends involves loss of the circular profile and buckling of the end which, ultimately, leads to eversion of the end profile. Abuse conditions may also arise when a container is dropped or distorted, or when the product within the container undergoes thermal processing.

One solution to the problem of loss of circular profile is provided by the can end which is described in our U.S. Pat. No. 6,065,634. The can end shell (that is, the unseamed can end) of that patent includes a peripheral curl, a seaming panel, a chuck wall at an angle of between 30° and 60°, a narrow anti-peaking bead and a centre panel. During seaming of the shell to the can body, the chuck wall is deformed at its upper end by contact with an anvil portion of the seaming chuck. The resulting profile provides a very strong double seam since the annulus formed by the seam has very high hoop strength and will resist distortion from its circular profile when subjected to thermal processing or when packaging carbonated beverages.

Stiffness is also provided to the beverage can end by the anti-peaking or countersink bead. This is an outwardly concave bead comprising inner and outer walls, joined by a curved portion. In the '634 patent this bead has walls which are substantially upright, although either may vary by up to +/−15°. This patent uses a small base radius (best fit) for the bead, typically 0.75 mm or less.

It is known from U.S. Pat. No. 6,089,072 that the width of the anti-peaking bead can be reduced by free drawing of the inner wall of the bead. This latter method avoids undue thinning of the bead as it is reworked. The resultant narrower bead optimises the stiffness of the can and, consequently, its resistance to buckling when attached to a can body having high internal pressure in the can.

Can ends such as those described in the above patents have high hoop strength and/or improved buckle performance such that they resist deformation when subjected to high internal pressure. In particular, the buckle pressure of the end of the '634 patent is well above the 90 psi can making industry minimum standard.

Whilst high hoop strength is predominantly beneficial it will affect the manner in which the can end ultimately fails. In a conventional can end, the circular periphery of the can end will tend to distort and become oval under high internal pressure. If the circular shape of the seamed end is free to distort to an oval shape under high internal pressure, as is usual, then part of the anti-peaking bead will open out along an arc at one end of the long axis of the oval shape as the can end everts locally.

However, in the can end of the '634 patent in particular, it has been found that the stiff annulus formed by the double seam resists such distortion. As a result, when subjected to severe abuse conditions, dropping during transport, mishandling by machinery, freezing etc, it has been found that the resultant failure mode may lead to leakage of can contents. When distortion of the seam or anti-peaking bead is resisted by a strong seam and/or anti-peaking bead, failure can be by eversion of the bead at a single point rather than along an arc. Such point eversion leads to pin hole leaks or even splitting of the can end due to the localised fatiguing of the metal and extreme conditions may even be explosive.

SUMMARY OF THE INVENTION

This invention seeks to control the failure mode and to avoid catastrophic failure and leaking, whilst still achieving buckle pressure performance well above the industry stipulated pressure of 90 psi.

According to the present invention, there is provided a can end shell comprising a centre panel, a countersink bead, an inclined chuck wall portion, and a seaming panel, and further including one or more control features, each feature extending around an arc of part of the countersink bead and/or the chuck wall whereby the failure mode of the can end, when seamed to a can body, is controlled, and in which the or each control feature comprises one or more of: an expansion of the countersink bead, a shelf in the outer wall of the countersink, an indentation in the chuck wall, and/or coining.

For the avoidance of doubt, it should be noted that the term "arc" as used herein is intended to include a 360° arc, i.e. a control feature or features which extend around the whole circumference of the can end shell. Furthermore, it should be noted that the term "inclined" is not intended to be limiting and the inclined chuck wall may have one or more parts, any of which may be linear or curved, for example.

A control feature, such as a selectively weakened region, may be introduced onto the can end in a variety of different ways, all of which are intended to limit or prevent the concentration of strain. Control features or weakenings may be achieved by increasing the radial position of the outer wall of the countersink bead, a shelf in the countersink bead, an indentation in the chuck wall, or coining. Numerous variations are possible within the scope of the invention, including those set out below.

Usually, a shelf in the countersink bead will be in the outer wall of the bead, and may be at any position up that wall. Clearly when the shelf is at the lower end of the outer wall it effectively corresponds to an expansion in the bead radius. A shelf or groove may be provided on any part of a radial cross-section through the bead but as the inner wall diameter position is often used as a reference for machine handling purposes and the thickness of the base of the countersink should ideally not be reduced, the outer wall is the preferred location.

Preferably, an indentation in the chuck wall should be made so that in the seamed can end, the indentation is positioned approximately at the root of the seam. In the end shell this means that the indentation should be made about half way up the chuck wall or in the upper half of the chuck wall, depending on the type of seam. The indentation may be made using radial and indent spacers to control the radial and penetration depth of the tool.

In one embodiment, a control feature may extend over a single arc behind the heel of the tab, centred on a diameter through the tab rivet and nose. Alternatively, there may be a pair of control features, symmetrically placed one on either side of the tab, and ideally centred at +/−90° or less from the heel (handle end) of the tab. In this embodiment, the arc length may be anything up to 90° in order to encompass any "thin point" due to orientation relative to grain orientation.

A control feature may comprise a combination of different types of control features, usually over at least a portion of the same arc of the can end such that, where the arcs are not fully circumferential, the different types are centred on the same can end diameter. For example, there may be an expansion of the bead wall/radius and an indentation in the chuck wall for the same or each control feature. In this example, the indentation in the chuck wall may extend over the same length of arc as the bead expansion, a longer or a shorter arc length, with the centres of the arcs being on the same end diameter. In yet another embodiment, there may additionally be a shelf-type groove, as well as the bead expansion and chuck wall indentation.

The countersink bead may have its base radius enlarged and then incorporate a control feature comprising a shelf in its outer wall. In one example, the arc length of the bead expansion (and, where present, the shelf) is less than the arc length of the chuck wall indentation, such that the bead expansion (and shelf) acts as a trigger for local peaking.

Where the control feature comprises an indentation or coined region on the chuck wall, this may extend either internally or externally, or a combination of these around the arc. For the purpose of this description, it is the side of the can end to which a tab is fixed which is referred to as "external" as this side will be external in the finished can. Preferably, however, the indentation extends inwardly as otherwise it may be removed by the seaming tool during seaming.

In a further embodiment, the end shell may additionally include coining of a shoulder between the inner wall of the countersink and the centre panel over an arc or pair of arcs.

The control feature is preferably made in a conversion press but it may be made in a shell press or even in a combination of the shell and conversion presses providing that orientation of the end is not an issue.

Whilst the terms "groove", "indentation" and "indent" have been used above, it should be appreciated that these terms also encompass any reshaping of the can end to form a control feature, including the use of a point indent or series of indents and other variations of points and grooves.

BRIEF DESCRIPTION OF THE FIGURES

Preferred embodiments of the invention will now be described, by way of example only, with reference to the drawings, in which.

DETAILED DESCRIPTION OF PREFERRED EMBODIMENTS

Figure 1:
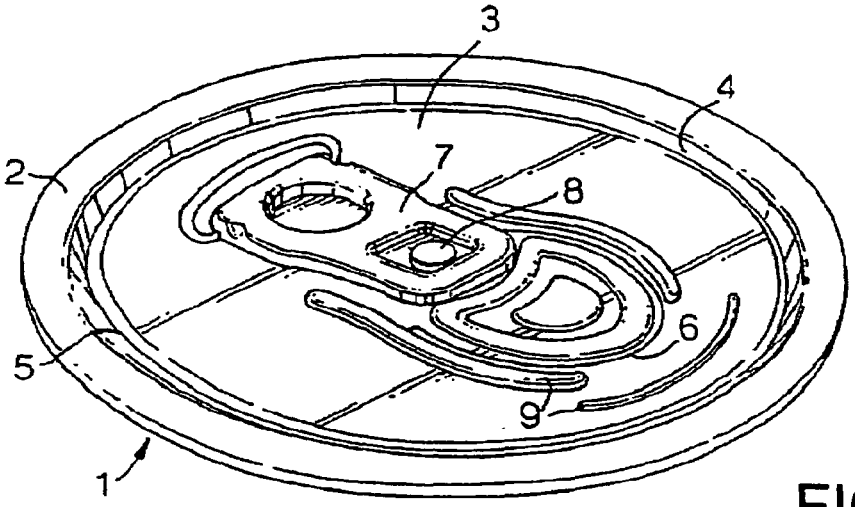
FIG. 1 is a perspective view of a conventional beverage can end.

The can end of FIG. 1 is a conventional beverage end shell 1 comprising a peripheral curl 2 which is connected to a centre panel 3 via a chuck wall 4 and anti-peaking reinforcing bead or countersink 5. The centre panel has a score line 6 which defines an aperture for dispensing beverage. A tab 7 is fixed to the centre panel 3 by a rivet 8, as is usual practice. Beads 9 are provided for stiffening the panel.

The can end of FIG. 1 when attached by seaming to a can body which is filled with carbonated beverage, for example, is typically able to withstand an internal pressure of 98 psi before buckling, 8 psi above the required minimum buckle pressure of 90 psi. When the pressure approaches and exceeds this value, the circular shape of the periphery of the end will distort and become oval. Eventually the centre panel will be forced outwardly so that the countersink "unravels" and flips over an arc of its circumference. Whilst a can which is buckled in such a manner is unlikely to be acceptable to a consumer, the can end itself is still intact, the tab 7 is still accessible and there is no compromise to the sealing of the container by such failure which could result in leaking of the contents.

It has been found by the present Applicant, however, that where a container has an end which is, by virtue of its design, substantially stiffer and has greater hoop strength than that of FIG. 1, the buckle failure mode differs from that described above. Such a can end is that of the '634 patent, the general shape of which is shown for reference in FIGS. 2A to 4B. The can end 20 is attached to a can body 21 by a double seam 22, as shown in FIGS. 4A and 4B. Inner portion 23 of the seam 22, which is substantially upright, is connected to a countersink bead 25 by a chuck wall 24. The countersink, or anti-peaking bead 25 has inner and outer walls 26 and 27, the inner wall 26 depending from the centre panel 28 of the end.

Whilst the higher hoop strength exhibited by this can end is of great importance in maintaining the overall integrity of the container, the mode in which the can fails under severe abuse conditions may be unacceptable and even, on occasion, catastrophic. Typical failure modes may compromise the integrity of the can by pin hole(s) and/or splitting of the can end. In extreme cases, the centre panel 28 is pushed outwardly by excessive internal pressure. As the panel moves outwardly, it pulls the inner wall 26 of the anti-peaking bead 25 with it. The inner portion 23 of seam 22 is "peeled" away from the rest of the seam as the can end is forced out. The explosive nature of this so-called "peaking" failure results in the formation of a bird's beak configuration with a pin hole at the apex of the "beak" where the force is concentrated in a single point at the base of the countersink 25.

The Applicants have discovered that by providing the can end with a control feature, a preferential "soft" peak is obtainable when the can end fails. Although this means that the can end may fail at a lower buckle pressure, the softer, less explosive nature of the peak results in a failure mode without pin hole or tearing. The introduction of a control feature thus controls the failure mode and avoids concentration of the forces at a single point.

Figure 3:
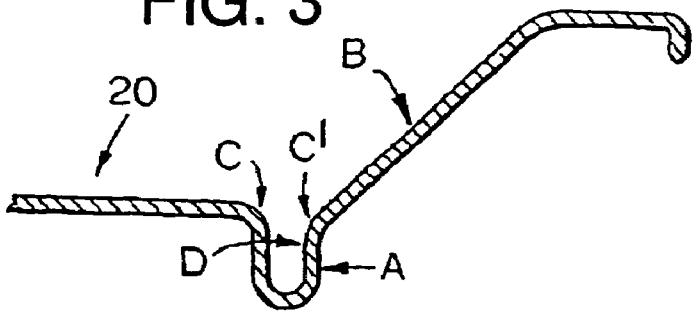
FIG. 3 is a partial side section of the can end of FIG. 2A, prior to seaming.
Figure 4A:
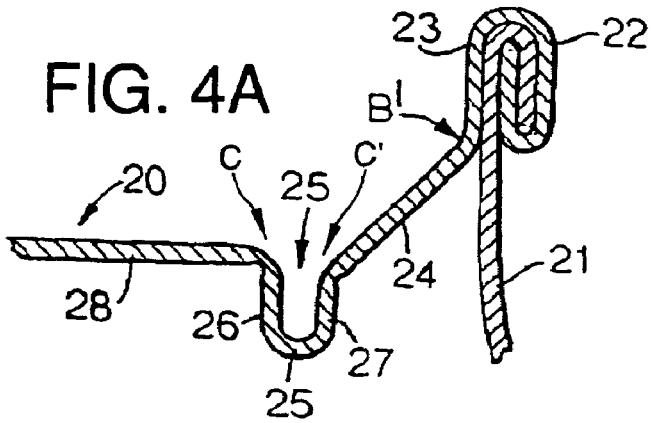
FIG. 4A is a partial side section of the can end of FIG. 2A, after seaming to a can body and illustrating control features.
Figure 5:
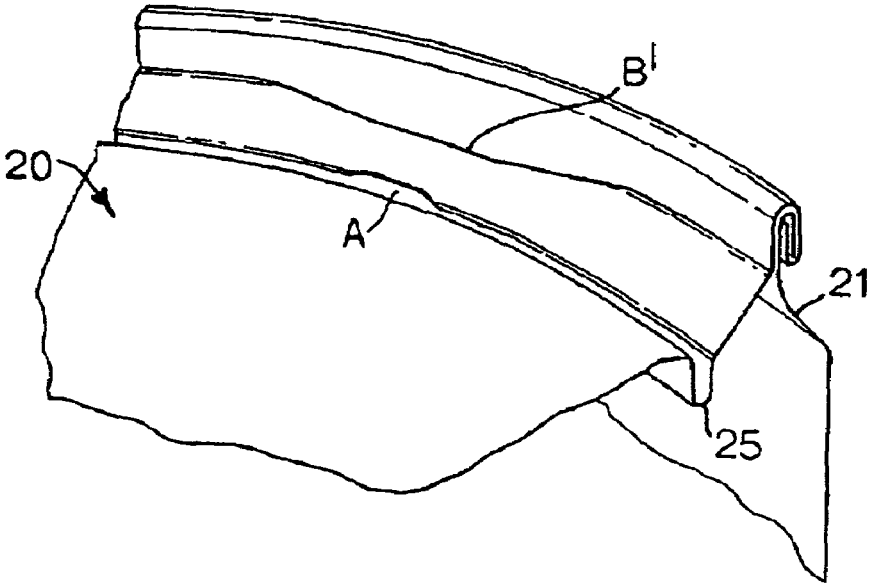
FIG. 5 is a sectioned perspective view of a seamed can end having two types of control features.
Figure 4B:
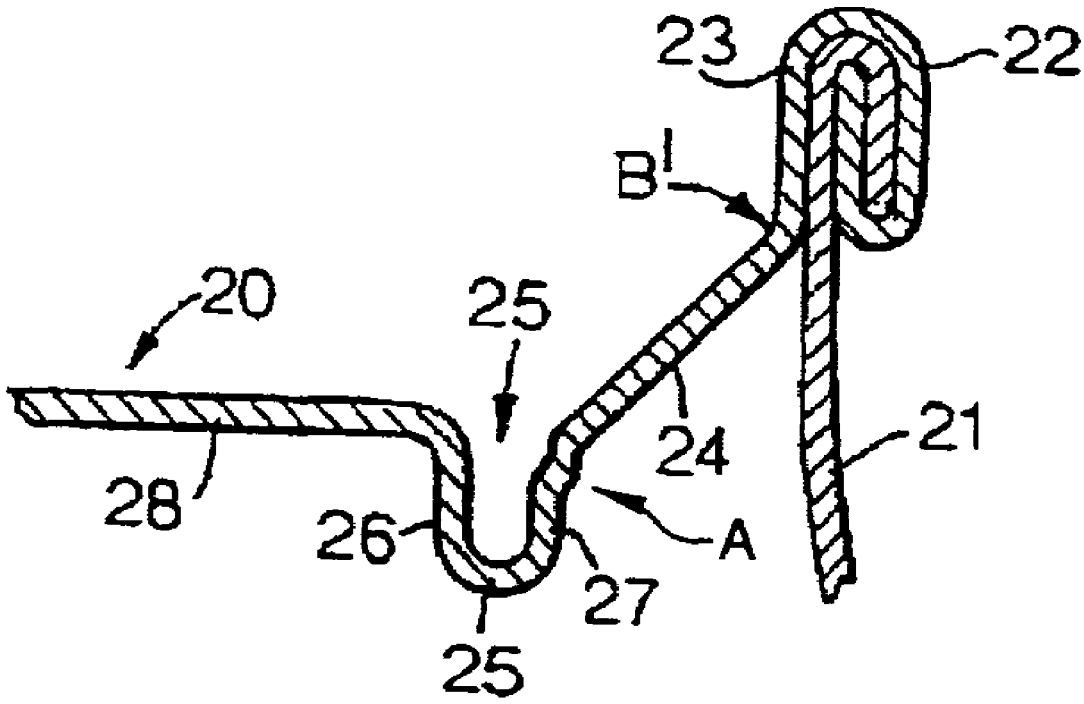
FIG. 4B is a partial side section of the can end of FIG. 2A, after seaming to a can body, illustrating other control features.

Control features in accordance with the invention can take a variety of forms including one or more of the following with reference to FIGS. 3, 4A, and 4B:

A. The radial position of the outer wall 27 of the countersink bead may be increased;

B. The chuck wall 24 may be coined or have indentations at or above approximately the mid-point such that this control feature is at the root of the seam 22 in the seamed can end (denoted as B');

C. Coining of the inner shoulder (C) of the countersink or of the outer shoulder (C');

D. A shelf may be made in the outer wall 27 of the countersink bead.

Figure 2A:
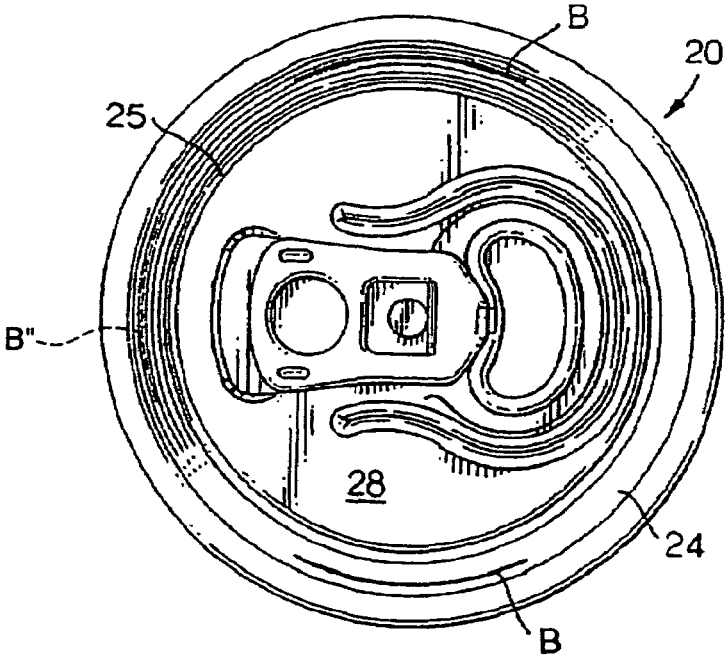
FIG. 2A is a plan view of another type of beverage can end schematically illustrating control feature locations.
Figure 2B:
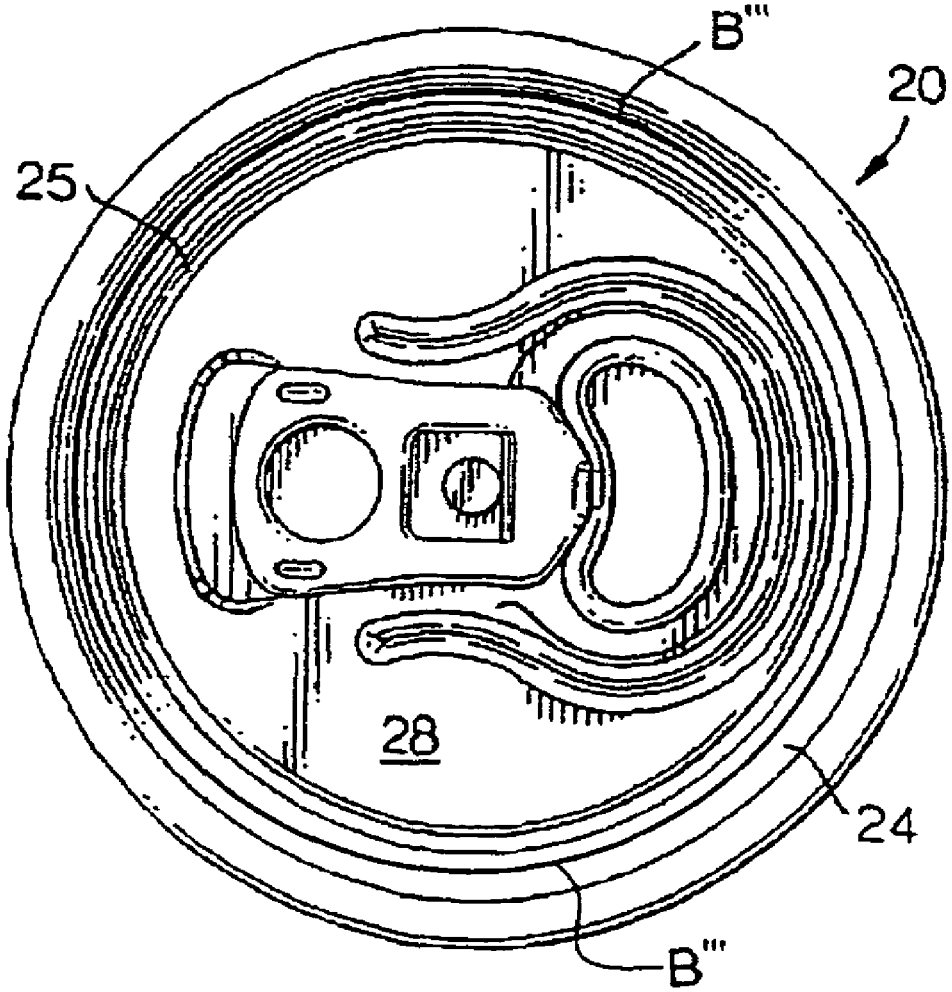
FIG. 2B is a plan view of the type of beverage can shown in FIG. 2A and schematically illustrating a 360 degree control feature.

FIG. 2A schematically shows control feature B located on each side of the diameter through a central axis of tab 7 and extending around an arc. F*igure* 2A also schematically shows a control feature, identified by the reference B" and shown in dashed lines, located behind the heel of tab 7 in an arc that is centered on a diameter through the tab central axis. FIG. 2B schematically illustrates a control feature, identified as reference B'", extending 360 degrees around the end. FIG. 4A schematically shows coining C of a shoulder between countersink inner wall 26 and center panel 28, and coining C' located on the shoulder between countersink outer wall 27 and chuck wall 24. FIG. 4B schematically illustrates a shelf in countersink outer wall 27.

When a type D region is at the lower part of the outer countersink wall, this may be equivalent to a type A control feature. Higher up the outer wall, a type D region takes the clear form of a shelf.

In a preliminary trial of the present invention, the shell having an overall shape shown in FIG. 2A and 3 was modified by a local groove in the outer wall of the countersink. This groove was ideally adjacent the handle of the tab so that any failure of the can end would be away from the score. Positioning either side of the tab or, indeed, at any position around the countersink was also considered possible. The groove was typically about 8 mm in arc length and was positioned approximately half way down the outer wall of the countersink bead, in the form of a shelf Computer modeling has showed that the provision of such a groove resulted in a failure mode similar to that of a conventional can end such as that of figure 1, with no leakage.

Modelling and bench testing has revealed that even better control of the failure mode was achievable when a pair of grooves were made at the base of the countersink outer wall. A variety of variables were modelled and then bench tested as follows:

| | |
|---|---|
| depth of groove | bottom of outer wall* |
| gap between grooves | 3 mm to 6 mm |
| radial interference (depth of penetration into outer wall) | 0.2 mm to 0.4 mm |
| orientation | behind (handle end of) tab<br>60° to tab left only<br>60° to tab right only<br>60° to tab left and right |

*This is equivalent to increasing the radial position of the countersink (anti-peaking) bead.

In bench testing of a small batch of cans using each of the above combinations, it was found that whilst the majority of cans leaked, the provision of a control feature controlled the position of peaking to the indentation site and all leaks were located on the peaks rather than on the tab rivet or score.

In spite of the fact that the cans of the initial trial still leaked on peaking, the Application discovered that the incident of leakage was greatly reduced by a combination of types of control features which may, individually, exhibit unacceptable leaking on peaking. The following examples show how the failure mode can not only be focussed on a particular site on the can end but also be controlled such that the can also has acceptable buckle performance. In all of these further trials, cans were heated to 100° F. before carrying out the drop tests.

EXAMPLE 1

Can ends were modified in the conversion press by expanding the countersink bead over a 60° arc at positions +/−90° of the tab heel. These ends were then seamed onto filled cans and dropped vertically, tab end down, onto a steel plate, the sheet steel being inclined at 30°. This extreme test is non-standard and tested the cans for severe abuse performance. The tests used the Bruceton staircase analysis and results are set out in table 1, where P=standard peak and PS=peak and score burst.

All cans tested peaked at the control feature without splitting. As with preliminary bench testing, the position of peaking was focussed on the indentation site.

Can ends modified in this way were also tested by pressurising a can to which the end was seamed ("seamed end test"). These results are shown in table 2. Whilst the cans all peaked on the indentation site and were still openable after peaking, only 25% survived testing without leaking on the peak location.

TABLE 1

(Bruceton staircase test)
Expanded countersink bead
Drop test (onto 30° sheet steel)

| CAN | HEIGHT (") | LEAK ON PEAK? | PEAK ON CONTROL FEATURE? | PEAK TYPE |
|---|---|---|---|---|
| 1 | 5 | N | Y | P |
| 2 | 10 | N | Y | PS |
| 3 | 5 | N | Y | P |
| 4 | 10 | N | Y | P |
| 5 | 15 | N | Y | PS |
| 6 | 10 | N | Y | PS |
| 7 | 5 | N | Y | P |
| 8 | 6 | N | Y | P |
| 9 | 7 | N | Y | P |
| 10 | 8 | N | Y | PS |
| 11 | 7 | N | Y | P |
| 12 | 8 | N | Y | PS |
| 13 | 7 | N | Y | P |
| 14 | 8 | N | Y | PS |
| 15 | 7 | N | Y | P |

TABLE 2

(SET test)

| CAN | PRESSURE (psi) | SURVIVE? | PEAK ON CONTROL FEATURE? | OPENABLE? |
|---|---|---|---|---|
| 1 | 95 | N | Y | Y |
| 2 | 93.4 | Y | Y | Y |
| 3 | 99.3 | N | Y | Y |
| 4 | 100.4 | N | Y | Y |
| Average | 97.0 | 25% | 100% | 100% |

P=standard peak with no leak

PS=peaked and burst at the score

EXAMPLE 2

Further can ends were then modified in the conversion press both by expanding the countersink bead over a 60° arc at positions +/−90° of the tab heel, and also by providing a indentation over a 50° arc at positions +/−90° in the upper chuck wall. These ends were then seamed onto filled cans and drop tested by dropping vertically, tab end down, onto a steel plate, the sheet steel being inclined at 30°. The results of the second tests are given in table 3, where again P=standard peak and PS=peak and score burst.

The combination of a countersink bead expansion and indentation in the chuck wall increases the average height at which peaking occurs. The countersink bead expansion was found to act as a trigger and this combination of a trigger and chuck wall indentation controls the peaking better than a countersink bead expansion alone (example 1).

Can ends modified in this way were also tested by pressurising a can to which the end was seamed ("seamed end test"). These results are shown in table 4.

In the results of table 4, all the cans again peaked on the indentation site and were still openable after peaking. In addition, 100% survived testing without leaking on the peak location, supporting the Applicant's discovery that by combining two types of control feature, performance in terms of leak-free failure mode is dramatically improved.

TABLE 3

(Bruceton staircase test)
Expanded countersink bead + chuck wall groove
Drop test (onto 30° sheet steel)

| CAN | HEIGHT (") | LEAK ON PEAK? | ON CONTROL FEATURE? | PEAK TYPE |
|---|---|---|---|---|
| 1 | 5 | N | Y | P |
| 2 | 10 | N | Y | P |
| 3 | 15 | Y | Y | P |
| 4 | 12 | Y | Y | P |
| 5 | 11 | N | Y | P |
| 6 | 12 | Y | Y | P |
| 7 | 11 | N | Y | P |

TABLE 3-continued (Bruceton staircase test)
Expanded countersink bead + chuck wall groove
Drop test (onto 30° sheet steel)

| CAN | HEIGHT (") | LEAK ON PEAK? | ON CONTROL FEATURE? | PEAK TYPE |
|---|---|---|---|---|
| 8 | 12 | Y | Y | P |
| 9 | 11 | N | Y | P |
| 10 | 10 | Y | Y | P |
| 11 | 8 | N | Y | PS |
| 12 | 9 | Y | Y | P |
| 13 | 8 | N | Y | P |
| 14 | 9 | Y | Y | P |
| 15 | 8 | N | Y | P |

TABLE 4

(SET test)

| CAN | PRESSURE (psi) | SURVIVE? | PEAK ON CONTROL FEATURE? | OPENABLE? |
|---|---|---|---|---|
| 1 | 93.7 | Y | Y | Y |
| 2 | 87 | Y | Y | Y |
| 3 | 93.2 | Y | Y | Y |
| 4 | 92.3 | Y | Y | Y |
| Average | 91.6 | 100% | 100% | 100% |

EXAMPLE 3

Can ends having an indentation in the upper chuck wall only (i.e. not in the countersink) were seamed to can bodies and then pressurised. Runs 1 to 8 had a single indentation behind the tab over an arc of about 40° to 50°. Runs 1-1 to 8-8 had indentations at +/−90° and over a 50° arc. Mean results are given throughout. Peak location indicates the incidence of a peak on the control feature. The spacer details explain the degree of indentation in the chuck wall.

TABLE 5

(SET test)

| RUN | Reversal pressure (psi) | % peak on control feature | Survival | Openable | Radial spacer (mm) | Indent spacer |
|---|---|---|---|---|---|---|
| 1 | 99.03 | 100% | 25% | 100% | 0.5 | 8.75 |
| 2 | 101.7 | 75% | 50% | 100% | 0 | 8.75 |
| 3 | 92.48 | 100% | 75% | 75% | 0 | 9.25 |
| 4 | 91.3 | 100% | 25% | 75% | 0.5 | 9.25 |
| 5 | 101.83 | 100% | 75% | 100% | 0.5 | 10.75 |
| 6 | 103.2 | 100% | 100% | 100% | 0 | 10.75 |
| 7 | 94.65 | 100% | 50% | 100% | 0 | 11.25 |
| 8 | 93.45 | 100% | 75% | 100% | 0.5 | 11.25 |
| 1—1 | 101.45 | 100% | 75% | 75% | 0.5 | 8.75 |
| 2—2 | 101.83 | 75% | 75% | 100% | 0 | 8.75 |
| 3—3 | 92.35 | 100% | 75% | 100% | 0 | 9.25 |
| 4—4 | 89.6 | 100% | 25% | 100% | 0.5 | 9.25 |
| 5—5 | 102.0 | 100% | 75% | 100% | 0.5 | 10.75 |
| 6—6 | 103.95 | 75% | 50% | 100% | 0 | 10.75 |
| 7—7 | 94.98 | 100% | 75% | 100% | 0 | 11.25 |
| 8—8 | 95.8 | 100% | 75% | 100% | 0.5 | 11.25 |
| CONTROL | 105.98 | N/A | 25% | 100% | N/A | N/A |

EXAMPLE 4

Further trials were conducted to confirm the effect of expansion of the countersink radius and the indentation in the upper chuck wall, both separately and together. Unmodified can ends were tested by way of control. The results are shown in tables 6 and 7.

The chuck wall indentations comprised a indentation on each side of the tab, set at 90° to the tab. Spacer conditions were as in example 3, but with a 9 mm indent ring spacer (rather than 8.75 mm).

The countersink "trigger" comprised a single bead expansion within the arc of the chuck wall indentation and centred on the same diameter (arc mid-point). This bead expansion was selected to trigger a peak within the chuck wall indentation as identified in example 2.

The control can ends give very low survival figures in both drop tests and seamed end testing (SET), i.e. the control can ends leak when they peak. The chuck wall indentation alone gives good hot drop (100° F.) and SET performance but seems to have higher incidence of score bursts during hot drop testing. The countersink ("c'sk") bead trigger creates a very symmetric end shape from the hot drop test and is very effective in determining the peak location. The countersink trigger reduces the SET performance to 89 psi average, but this is believed to be attributable to the tooling used to create the indentations. In general "1" means yes and "0" means no, except in position in which 1 indicates the position of peak on the control feature.

TABLE 6

(Bruceton staircase comparing unmodified with various modified can ends)

| Unmodified control | | | C'sk bead trigger only | | | | Chuck wall only | | | | Both features | | | |
|---|---|---|---|---|---|---|---|---|---|---|---|---|---|---|
| Height | Leak ? | Leak type | Height | Leak ? | Position? | Leak Type | Height | Leak ? | Position? | Leak Type | Height | Leak ? | Position? | Leak Type |
| 5 | y | p | 5 | Y | 1 | p × 2 | 5 | n | 0 | p × 2 | 5 | Y | 1 | clam-shell |
| 4 | y | p | 4 | Y | 1 | p × 2 | 5 | y | 1 | p | 4 | N | 1 | p × 2 |
| 3 | y | p | 3 | Y | 1 | p × 2 | 4 | n | 1 | p | 5 | Y | 1 | p × 2 |
| 2 | y | p | 2 | Y | 1 | p × 2 | 5 | n | 1 | p | 4 | N | 1 | p × 2 |
| 1 | y | score burst | 1 | Y | 1 | score burst | 6 | n | 1 | p | 5 | N | 1 | p × 2 |
| 1 | n | none | 1 | Y | 1 | score burst | 7 | y | 1 | score burst | 6 | Y | 1 | p × 2 |
| 1 | n | p | 1 | N | 1 | score burst | 6 | y | 1 | p × 2 | 5 | N | 1 | p × 2 |
| 2 | y | p | 2 | N | 1 | score burst | 5 | n | 1 | p × 2 | 6 | N | 1 | p × 2 |
| 1 | y | p × 2 | 3 | Y | 1 | p × 2 | 6 | y | 1 | p × 2 | 7 | Y | 1 | p × 2 |
| 1 | y | score burst | 2 | Y | 1 | p × 2 | 5 | n | 1 | p | 6 | Y | 1 | p × 2 |
| 1 | y | p | 1 | Y | 0 | p × 2 | 6 | n | 1 | p × 2 | 5 | N | 1 | p × 2 |
| 1 | n | p | 1 | Y | 1 | score burst | 7 | n | 1 | p × 2 | 6 | N | 1 | p × 2 |
| 2 | n | p | 1 | N | 1 | p × 2 | 8 | n | 1 | p | 7 | Y | 1 | p × 2 |
| 3 | y | p | 2 | Y | 1 | score burst | 9 | n | 1 | score burst | 6 | Y | 1 | p × 2 |
| 2 | n | p × 2 | 1 | N | 0 | p × 2 | 9 | n | 1 | score burst | 5 | N | 1 | p × 2 |
| 3 | y | p | 1 | N | 1 | score burst | 9 | y | 1 | p × 2 | 6 | N | 1 | p × 2 |
| 2 | y | p | 2 | Y | 1 | p × 2 | 8 | n | 1 | p × 2 | 7 | N | 1 | p × 2 |
| 1 | n | none | 1 | Y | 1 | p × 1 | 9 | y | 1 | score burst | 8 | N | 1 | p × 2 |
| 2 | n | p | 1 | N | 1 | p × 1 | 8 | n | 1 | p × 2 | 9 | Y | 1 | p × 2 |
| 3 | n | p | 2 | Y | 1 | p × 1 | 9 | n | 1 | p × 2 | 8 | Y | 1 | p × 2 |
| 4 | y | p × 2 | 1 | Y | 1 | p × 1 | 10 | y | 1 | p × 2 | 7 | N | 1 | p × 2 |
| 3 | n | p | 1 | Y | 1 | p × 1 | 9 | n | 1 | p × 2 | 8 | N | 1 | p × 2 |
| 4 | n | p | 1 | Y | 1 | score burst | 11 | n | 1 | p × 2 | 9 | Y | 1 | p × 2 |
| 5 | y | p | 1 | Y | 1 | score burst | 12 | n | 1 | p × 2 | 8 | Y | 1 | p × 2 |
| 4 | y | p | 1 | Y | 1 | score burst | 13 | n | 1 | p × 2 | 7 | Y | 1 | clam-shell |
| 3 | y | p | 1 | Y | 1 | score burst | 14 | n | 1 | p × 2 | 6 | Y | 1 | p × 2 |
| 2 | y | p × 2 | 1 | Y | 1 | p × 2 | 15 | n | 1 | p × 2 | 5 | N | 1 | p × 2 |
| 1 | y | p × 2 | 1 | Y | 1 | score burst | 15 | y | 1 | p × 2 | 6 | Y | 1 | p × 2 |
| 1 | n | p | 1 | Y | 1 | score burst | 14 | n | 1 | p × 2 | 5 | N | 1 | p × 2 |
| 2 | n | p | | | 93% | | | | 97% | | | | 100% | |

TABLE 7

(SET comparisons of unmodified with modified can ends)

| | Can 1 | Can 2 | Can 3 | Can 4 | Can 5 | Can 6 | Can 7 | Can 8 | Can 9 | Can 10 | Average |
|---|---|---|---|---|---|---|---|---|---|---|---|
| UNMODIFIED | | | | | | | | | | | |
| BUCKLE PRESSURE (psi) | 103.4 | 101.1 | 99.7 | 101.6 | 104.4 | 102.9 | 98.3 | 97.9 | 98.3 | 108 | 102 |
| POSITION ? | n/a | n/a | n/a | n/a | n/a | n/a | n/a | n/a | n/a | n/a | n/a |
| SURVIVED ? | 1 | 0 | 0 | 0 | 0 | 0 | 0 | 0 | 0 | 1 | 20% |
| OPENS ? | 1 | 1 | 1 | 1 | 1 | 0 | 1 | 1 | 1 | 1 | 90% |

TABLE 7-continued (SET comparisons of unmodified with modified can ends)

| | Can 1 | Can 2 | Can 3 | Can 4 | Can 5 | Can 6 | Can 7 | Can 8 | Can 9 | Can 10 | Average |
|---|---|---|---|---|---|---|---|---|---|---|---|
| C'sk BEAD TRIGGER DENT ONLY | | | | | | | | | | | |
| BUCKLE PRESSURE (psi) | 88.4 | 91.9 | 92.5 | 91.7 | 91.2 | 91.4 | 91.1 | 92 | 95 | 92.7 | 92 |
| POSITION ? | 1 | 1 | 1 | 1 | 1 | 1 | 1 | 1 | 1 | 1 | 100% |
| SURVIVED ? | 0 | 0 | 0 | 0 | 0 | 0 | 0 | 0 | 0 | 0 | 0% |
| OPENS ? | 1 | 1 | 1 | 1 | 1 | 1 | 1 | 1 | 1 | 1 | 100% |
| CHUCK WALL DENT ONLY | | | | | | | | | | | |
| BUCKLE PRESSURE (psi) | 96.6 | 95.7 | 92.7 | 93.7 | 94.3 | 94.6 | 92 | 95.1 | 93.7 | 95.5 | 94 |
| POSITION ? | 1 | 1 | 1 | 1 | 1 | 1 | 1 | 1 | 1 | 1 | 100% |
| SURVIVED ? | 1 | 1 | 1 | 1 | 1 | 1 | 1 | 0 | 1 | 1 | 90% |
| OPENS ? | 1 | 1 | 1 | 1 | 1 | 1 | 1 | 0 | 1 | 1 | 90% |
| BOTH DENTS | | | | | | | | | | | |
| BUCKLE PRESSURE (psi) | 86.6 | 90.5 | 87.7 | 87.6 | 88.5 | 92.7 | 90.3 | 86.3 | 87.5 | | 89 |
| POSITION ? | 1 | 1 | 1 | 1 | 1 | 1 | 1 | 1 | 1 | | 100% |
| SURVIVED ? | 1 | 1 | 1 | 1 | 1 | 1 | 1 | 1 | 1 | | 100% |
| OPENS ? | 1 | 1 | 1 | 0 | 1 | 1 | 1 | 1 | 1 | | 89% |

EXAMPLE 5

Further seamed end tests were carried out on both unmodified can ends ("control samples") and can ends having a 360° control feature in the form of a shelf in the outer wall of the countersink bead. Results of these trials are given in table 8. Buckle pressure performance was well above the 90 psi industry standard for all cans, both standard and modified. Only 25% of the control samples survived testing without leaking, whereas 100% of the cans having a control feature (circumferential shelf in the countersink bead) passed the test without leaking.

The invention has been described above by way of example only and numerous changes and/or permutations may be made within the scope of the invention as filed. It should also be noted that the control features of the invention are particularly intended for use on beverage can ends which are to be fixed to a can body and thereby subjected to internal pressure. Furthermore, the control features may be used on can ends having any chuck wall angle whether conventional (less than 15°) or larger, such as that of the '634 patent, i.e. 30° to 60°.

TABLE 8

| Control Samples | | Shelf in Bead | |
|---|---|---|---|
| Buckle Pressure (psi) | | Buckle Pressure (psi) | Leak |
| 102.6 | n | 98.1 | n |
| 102.3 | n | 104.1 | n |
| 105.6 | y | 102.3 | n |
| 105.6 | y | 96.8 | n |
| 101.5 | n | 103.4 | n |
| 101.7 | y | 103.5 | n |
| 102.5 | y | 104 | n |
| 104.6 | y | 103.5 | n |
| 107 | n | 99.8 | n |
| 103.4 | y | 105 | n |
| 103.5 | y | 103.6 | n |
| 104.2 | y | 104.1 | n |
| 103.6 | n | 103.9 | n |
| 102.2 | n | 104 | n |
| 103 | n | 102.2 | n |

TABLE 8-continued

| Control Samples | | Shelf in Bead | |
|---|---|---|---|
| Buckle Pressure (psi) | | Buckle Pressure (psi) | Leak |
| 103 | y | 103.1 | n |
| 103.5 | y | 105.5 | n |
| 105.1 | y | 104.5 | n |
| 102.8 | y | 101.9 | n |
| 102.8 | y | 104.1 | n |
| 104.7 | y | 100.5 | n |
| 103.8 | y | 103.2 | n |
| 103.8 | y | 102.3 | n |
| 105.9 | y | 101.9 | n |
| 104.5 | y | 105.7 | n |
| 103.3 | y | 105.6 | n |
| 103.3 | y | 98.6 | n |
| 104.5 | y | 101.3 | n |

The invention claimed is:

1. A can end shell comprising a center panel, a countersink bead, a chuck wall portion, a seaming panel, and a peak triggering strain-limiting shelf, the shelf extending around an arc of at least part of an outer wall of the countersink bead and located below the height of the center panel.

2. An end shell according to claim 1, in which the shelf extends around the whole circumference of the end shell.

3. An end shell according to claim 1, in which the shelf extends over an arc behind the heel of a tab fixed to the can end, and centered on a diameter through a tab central axis.

4. An end shell according to claim 1, in which a shelf is disposed on each side of a diameter through a tab central axis and each extending around an arc of the can end.

5. An end shell according to claim 3, in which the arc length is 90° or less.

6. An end shell according to claim 1, in which said end shell includes two or more strain-limiting shelves extending around an arc centered on the same diameter of the can end.

7. An end shell according to claim 1, further comprising an indentation in the chuck wall, extending around an arc centered on the same can diameter.

8. An end shell according to claim 1, in which an indentation or coined region is positioned at least partially in the upper half of the chuck wall, extending either internally or externally, or a combination of these.

9. An end shell according to claim 1, further comprising coining of a shoulder between the inner wall of the countersink and the center panel over an arc or pair of arcs.

10. An end shell according to claim 1, in which the shelf is made in either a shell press or a conversion press or a combination of these.

11. An end shell according to claim 4, wherein the arc length is 90° or less.

12. An end shell according to claim 1, wherein the chuck wall portion is inclined relative to an axis perpendicular to the exterior of the center panel by an angle of between 30 degrees and 60 degrees.

13. An end shell according to claim 1, wherein (i) the outer wall of the countersink bead includes an upper half and a lower half, and (ii) the shelf is in the lower half.

14. An end shell according to claim 1, wherein (i) the outer wall of the countersink bead includes an upper half and a lower half, and (ii) the shelf is in the upper half.

15. An end shell according to claim 1, wherein the shelf is located proximate the region of force concentration in the countersink bead.

16. A can end shell comprising:

a center panel;

a countersink bead about the periphery of the center panel;

a chuck wall portion located radially outwardly from the countersink, the chuck wall inclined relative to an axis perpendicular to the exterior of the center panel by an angle of between 30 degrees and 60 degrees;

a seaming panel located radially outwardly from the chuck wall; and a peak triggering strain-limiting shelf the shelf extending around an arc of at least part of an outer wall of the countersink bead and located proximate the region of force concentration in the countersink bead.

* * * * *